US009893416B2

(12) United States Patent
Jenaiah

(10) Patent No.: US 9,893,416 B2
(45) Date of Patent: Feb. 13, 2018

(54) ANTENNA ASSEMBLY FOR A MOTOR VEHICLE AND MOTOR VEHICLE HAVING AN ANTENNA ASSEMBLY

(71) Applicant: Bayerische Motoren Werke Aktiengesellschaft, Munich (DE)

(72) Inventor: Ali Jenaiah, Munich (DE)

(73) Assignee: Bayerische Motoren Werke Aktiengesellschaft, Munich (DE)

( * ) Notice: Subject to any disclaimer, the term of this patent is extended or adjusted under 35 U.S.C. 154(b) by 223 days.

(21) Appl. No.: 14/539,444

(22) Filed: Nov. 12, 2014

(65) Prior Publication Data

US 2015/0130674 A1 May 14, 2015

(30) Foreign Application Priority Data

Nov. 12, 2013 (DE) ..... 10 2013 222 951

(51) Int. Cl.
*H01Q 1/32* (2006.01)

(52) U.S. Cl.
CPC ..... *H01Q 1/3275* (2013.01)

(58) Field of Classification Search
CPC .... H01Q 1/085; H01Q 1/1214; H01Q 1/1221; H01Q 1/1271; H01Q 1/1285; H01Q 1/282; H01Q 1/283; H01Q 1/325; H01Q 1/3275; H01Q 1/3291; H01Q 9/30; H01Q 9/32; H01Q 9/34; H01Q 1/3208
See application file for complete search history.

(56) References Cited

U.S. PATENT DOCUMENTS 4,010,976 A * 3/1977 Shields ..... B62J 17/02 296/78.1
5,300,936 A 4/1994 Izadian
5,918,183 A * 6/1999 Janky ..... B60R 25/102 340/539.13
6,275,194 B1 * 8/2001 Ansorge ..... H01Q 1/3275 343/713
6,778,143 B2 * 8/2004 Morita ..... B60C 23/006 343/702
7,253,778 B1 * 8/2007 Bingle ..... H01Q 1/325 343/711
7,306,276 B2 * 12/2007 Berberich ..... B60R 7/04 296/193.04
7,679,572 B2 * 3/2010 Gray ..... H01Q 1/3275 343/713

(Continued)

FOREIGN PATENT DOCUMENTS

DE 39 15 152 A1 12/1989
DE 44 03 643 A1 8/1995

(Continued)

OTHER PUBLICATIONS

German Search Report dated Mar. 21, 2014, including partial English translation (eleven (11) pages).

*Primary Examiner* — Tho G Phan
*Assistant Examiner* — Patrick Holecek
(74) *Attorney, Agent, or Firm* — Crowell & Moring LLP

(57) ABSTRACT

An antenna assembly for a motor vehicle particularly has an antenna rod and an antenna base module. The antenna base module is arranged between an outer panel component of the vehicle body and a vehicle body shell component. Furthermore, the antenna rod is arranged on an exterior side of the outer panel component of the vehicle body.

18 Claims, 2 Drawing Sheets

(56) References Cited

U.S. PATENT DOCUMENTS

| | | | | |
|---|---|---|---|---|
| 2006/0152941 | A1* | 7/2006 | Chiang | B60Q 1/2661 362/540 |
| 2014/0028507 | A1 | 1/2014 | Mierke et al. | |
| 2014/0062807 | A1* | 3/2014 | Hirayama | H01Q 1/325 343/713 |

FOREIGN PATENT DOCUMENTS

| | | | |
|---|---|---|---|
| DE | 44 43 596 | A1 | 6/1996 |
| DE | 197 47 961 | A1 | 5/1999 |
| DE | 200 02 426 | U1 | 4/2000 |
| DE | 101 44 399 | A1 | 4/2003 |
| DE | 101 44 403 | A1 | 7/2003 |
| DE | 102 19 222 | A1 | 11/2003 |
| DE | 203 14 009 | U1 | 1/2004 |
| DE | 10 2004 055 175 | A1 | 5/2006 |
| DE | 10 2005 050 256 | A1 | 5/2007 |
| DE | 10 2009 036 727 | A1 | 3/2010 |
| DE | 10 2011 106 829 | A1 | 3/2012 |
| DE | 10 2011 016 294 | A1 | 10/2012 |
| EP | 1 777 112 | B1 | 10/2008 |
| FR | 2 742 584 | A1 | 6/1997 |

* cited by examiner

ANTENNA ASSEMBLY FOR A MOTOR VEHICLE AND MOTOR VEHICLE HAVING AN ANTENNA ASSEMBLY

CROSS REFERENCE TO RELATED APPLICATION

This application claims priority under 35 U.S.C. § 119 from German Patent Application No. 10 2013 222 951.8, filed Nov. 12, 2013, the entire disclosure of which is herein expressly incorporated by reference.

BACKGROUND AND SUMMARY OF THE INVENTION

The present invention relates to an antenna assembly for a motor vehicle having an antenna rod and an antenna base module. Furthermore, the present invention relates to a motor vehicle having such an antenna assembly.

It is known to arrange a rod antenna having an antenna rod as a receiver for radio reception on an outer panel component of a motor vehicle. It is further known to combine rod antennas with an antenna module, which contains additional antennas as well as a pertaining electronic system. Such an antenna module is frequently mounted in a base of such a rod antenna. The antenna rod may be detachably fastened to the antenna base. The antenna base is, in turn, placed on the outer panel component of the vehicle body, the required connection cable being guided from the antenna base through the outer panel component of the vehicle body component to the inside of the vehicle body.

Furthermore, a plurality of possibilities is known, where an antenna, including the receiver element, is arranged below an outer panel component of the vehicle body component. German Published Patent Application DE 102004055175 A1, for example, illustrates an antenna which is mounted on a transverse roof bow, the antenna therefore being entirely arranged between an outer roof panel and a vehicle ceiling.

It is an object of the present invention to create an antenna assembly for a motor vehicle as well as a motor vehicle having such an antenna assembly, which has an antenna rod and an antenna base module, the antenna assembly being better protected and more favorably fluidically positioned on the motor vehicle.

This and other objects are achieved by an antenna assembly for a motor vehicle, wherein the antenna assembly has an antenna rod as an antenna receiver element and an antenna base module, the antenna base module being arranged between an outer panel component of the vehicle body and a vehicle body shell component, and the antenna rod being arranged on the exterior side of the outer panel component of the vehicle body, as well as to a motor vehicle having such an antenna assembly.

In particular, an antenna assembly according to the invention for a motor vehicle has an antenna rod as an antenna receiver element and an antenna base module. The antenna base module is arranged between an outer panel component of the vehicle body and a vehicle body shell component. Furthermore, the antenna rod is arranged on the exterior side of the outer panel component of the vehicle body.

In particular, the antenna rod is detachably fastened to the antenna base module. Furthermore, the antenna rod is, particularly as a rod-shaped antenna receiver element, appropriately designed for a reception of electromagnetic waves, particularly radio waves.

An outer panel component of the vehicle body is a component that is visually seen from the outside as a component of the vehicle body. The antenna assembly according to the invention can, therefore, combine the advantages of an antenna rod, which projects from the outer panel component of the vehicle body and, therefore, can be optimally positioned for a good reception, particularly for a good radio reception, and of an antenna base module arranged below an outer panel component of the vehicle body. The antenna base module can be accommodated in a space-saving manner in an installation space between the outer panel component of the vehicle body and a vehicle body shell. Furthermore, under the outer panel component of the vehicle body, the antenna base module is particularly well protected from environmental influences. In addition, such an arrangement of the antenna base module can meet aesthetic as well as fluidic demands. In particular, the antenna base module can therefore be accommodated with little or no impairment of the drag coefficient. Furthermore, the antenna base module may be mounted so that it is not very visible or not visible at all.

According to a preferred further development, the antenna base module has at least one additional antenna receiver element. A further antenna receiver element can be designed particularly for a reception of electromagnetic waves for a DAB, a GPS, a GSN, an SDARS and/or a TV reception. Furthermore, the antenna base module may, in addition or as an alternative, have an integrated electronic system. Such an electronic system may, for example, be a receiving device, a transmitting device, a preamplifying device, a filtering device and/or a converting device or the like.

In this case, it is particularly advantageous that the additional antenna receiver element or the associated electronic system can be accommodated in a well-protected manner under the outer panel component of the vehicle body. A space under the outer panel component of the vehicle body can be utilized for this purpose.

According to a preferred further development, the antenna base module has a coupling and holding device for the antenna rod. In other words, the antenna rod is mechanically held by the antenna base module and, particularly, is also electrically coupled with the latter.

The coupling and holding device for the antenna rod is therefore also mounted or arranged under the outer panel component of the vehicle body.

The outer panel component of the vehicle body is particularly preferably constructed in areas, or completely, of a non-metallic material. It therefore becomes possible to accommodate in the antenna base module further antenna receiver elements or a further antenna receiver element, without any electromagnetic shielding of the antenna base module by the outer panel component of the vehicle body. This, thereby permits a reception of electromagnetic waves or also a transmitting of electromagnetic waves. Particularly, a plastic material is best suited for this purpose.

Particularly advantageously, the outer panel component of the antenna assembly according to the present invention is designed as a screen, which is, for example, mounted on an upper cowl. The screen can therefore be constructed adjacent to an upper end of a windshield or a rear window.

The outer panel component of the vehicle body may particularly be designed in an alignment with other adjoining outer panel components of the vehicle body, so that the transition between the adjoining outer panel components of the vehicle body is essentially continuous or flush and without steps. "Continuous and without steps" may mean in this case that a gap is formed between the parts, which is customary in vehicle body construction. The gap may, in turn, essentially be filled by a seal.

The vehicle body shell component may be a structurally effective roof bow. The term "structurally effective" means that the vehicle body shell component contributes significantly to stability, particularly crashworthiness, and rigidity of the vehicle body. The screen at the upper cowl is particularly preferably used in the case of convertible vehicles.

According to a preferred embodiment of the present invention, the antenna base module is fastened to the outer panel component of the vehicle body. In this case, the outer panel component of the vehicle body may have a fastener for the antenna base module on its interior side.

This facilitates the manufacturing of the motor vehicle because the antenna assembly consisting of the ferrite antenna, the outer panel component of the vehicle body and the antenna base module can be furnished in a preassembled state and can be mounted on the motor vehicle or the motor vehicle body in one operation.

As an alternative, the antenna base module may, however, also be fastened to the vehicle body shell component.

This is particularly advantageous when the outer panel component of the vehicle body is not suitable for mounting an antenna base module on the latter. In this case, no fastener for the fastening of the antenna base module is required at the outer panel component of the vehicle body.

However, it is also contemplated that the antenna base module is fastened to the outer panel component of the vehicle body as well as to the vehicle body shell component.

The outer panel component of the vehicle body preferably extends from a left roof side frame to a right roof side frame.

The outer panel component may therefore be an outer roof panel component or a part of an outer roof panel. In particular, the outer panel component of the vehicle body may be a complete outer roof panel of a motor vehicle with a stationary roof.

According to a preferred further development, the outer panel component of the vehicle body may have an opening for the detachable linking or coupling of the antenna rod. The antenna rod can thereby be mounted from the outside of the outer panel component on the antenna base module. The antenna base module may be connected with the outer panel component of the vehicle body, for example, by way of a locknut or another fastening device at the opening.

Preferably, a projecting area of the outer panel component of the vehicle body is constructed around the area of the above-mentioned opening, which area is elevated with respect to a remaining area of the outer panel component of the vehicle body, so that a space for the antenna base module is formed underneath the projecting area.

As a result, the antenna base module may have a larger construction and can therefore have additional elements, such as antenna reception elements and an electronic system, as described above. The projecting area is particularly advantageous if little or no space for the antenna base module is available between the outer panel component of the vehicle body and the vehicle body shell component.

However, as an alternative or in addition, the body shell component may also have a corresponding indentation for accommodating the antenna base module or a part of the antenna base module, so that the projecting area of the outer panel component of the vehicle body may clearly be smaller.

Furthermore, the outer panel component of the vehicle body may have no projecting area whatsoever around the opening, so that the outer panel component of the vehicle body has no additional elevation whatsoever of the outer panel of the vehicle body.

The above-described projecting/elevated area of the outer panel component may preferably be shaped with a view to a low drag and/or a beautiful aesthetic shape.

The above-listed further developments of the antenna assembly according to the present invention can be arbitrarily mutually combined to an extent possible.

The present invention is further aimed at a motor vehicle or a motor vehicle body which has the above-described antenna assembly in all its further developments.

Other objects, advantages and novel features of the present invention will become apparent from the following detailed description of one or more preferred embodiments when considered in conjunction with the accompanying drawings.

DETAILED DESCRIPTION OF THE DRAWINGS

In the following, an embodiment of the present invention will be described with reference to the figures.

Figure 2:
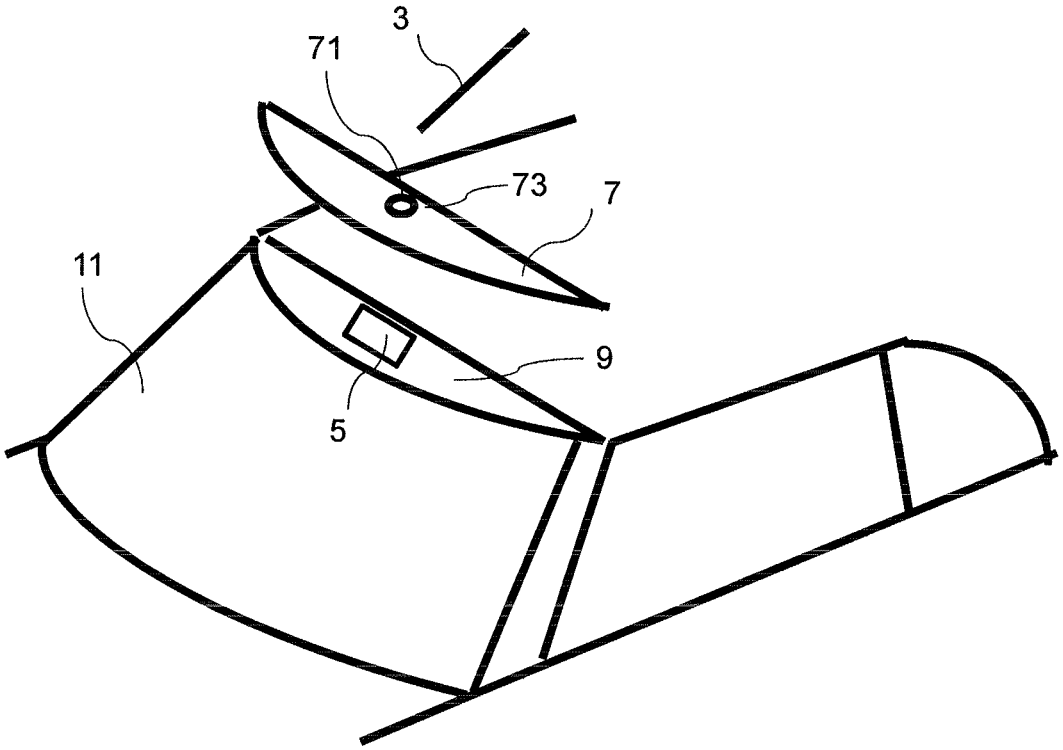
FIG. 2 is a schematic perspective partially exploded view of a part of a motor vehicle having the antenna assembly according to the embodiment of the present invention.

FIG. 2 is a perspective schematic exploded view of an antenna rod 3, an antenna base module 5, a cowl screen 7 and an upper cowl 9 according to the embodiment of the present invention. The antenna rod 3 and the antenna base module 5 form an antenna assembly 3 according to the invention. The outer panel component of the vehicle body according to the invention is constructed by the cowl screen 7, which extends over the upper cowl 9, which forms the body shell component according to the invention, of a convertible-type motor vehicle. The cowl screen 7 extends from a left end to a right end of the upper cowl 9 and therefore from a left A-pillar to a right A-pillar and, at its front edge, borders on a windshield 11. Increased demands are made on the upper cowl 9 in the case of a convertible-type motor vehicle with respect to crashworthiness and stiffness together with the A-pillars, with which the upper cowl 9 is connected. In particular, the upper cowl 9 together with the A-pillars of the motor vehicle is constructed such that they pass a roof indentation test.

The antenna rod 3 and the antenna base module 5 according to the present embodiment are mounted with respect to a y-direction, thus a direction transversely to the driving direction and transversely to the vertical direction of the vehicle, in the center of the upper cowl 9. The antenna base module 5 is mounted directly on the cowl screen 7 and has a mechanical coupling and holding device in the form of a thread 51 (see FIG. 1) for screwing in and fastening the antenna rod 3. In the cowl screen 7, an opening 71 is provided, through which the antenna rod 3 can be mounted on the antenna base module 5. For this purpose, the antenna rod 3 is provided with a known external thread. Furthermore, a known seal can be provided on the antenna rod, which seal prevents a penetration of dirt and liquid in the case of the mounted antenna rod 3 into the opening 71.

The antenna base module 5 has additional antenna reception elements, as, for example, for a DAB reception and a GPS reception. Further, the antenna base module 5 has various electronic system components. In order not to impair the reception of the DAB and of the GPS antenna reception elements, the cowl screen 7 consists of a plastic material.

Figure 1:
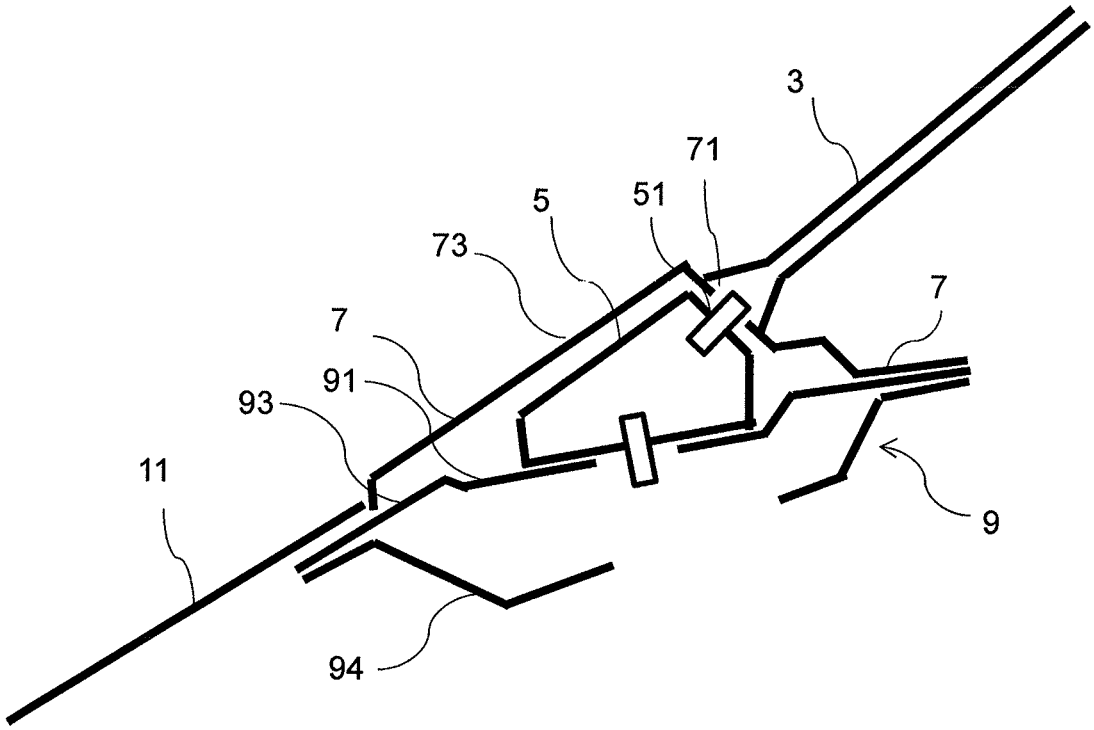
FIG. 1 is a schematic sectional view of an antenna assembly according to an embodiment of the present invention.

As illustrated particularly in the schematic sectional view of FIG. 1, the cowl screen 7 has a projecting/elevated area 73 in the area of the opening 71 and of the antenna base module 5, so that sufficient space is present for the accommodation of the antenna base module 5. Likewise, the upper cowl 9 has an indentation 91, which also provides additional space between the cowl screen 7 and the upper cowl 9 for accommodating the antenna base module 5. As illustrated in the sectional view, the antenna rod 3 is screwed into the thread 51 of the antenna base module 5 through the opening 71 of the cowl screen 7.

The elevated area 73 of the cowl screen 7 is fluidically shaped to have a low aerodynamic drag and also to provide a beautiful aesthetic appearance, in which case the schematic sectional view of FIG. 2 illustrates a very angular shape, which may, in fact, be provided with fluidically advantageous and visually attractive curves.

The upper cowl 9 is implemented in a shell construction consisting of an upper shell 93 and a lower shell 94, which form a hollow profile. The antenna base module 5 is arranged between the upper shell 93 and the cowl screen 7. The indentation 91 is formed in the upper shell 93.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. An antenna assembly for a motor vehicle, comprising:
an antenna rod configured as an antenna receiver element;
a separately mountable antenna base module comprising a coupler and holder for the antenna rod,
an outer panel component of a vehicle body of the motor vehicle having an opening for detachably fastening the antenna rod; and
a vehicle body shell component of the motor vehicle, wherein
the antenna base module, including the coupler and holder for the antenna rod, is arranged under the outer panel component and between the outer panel component and the vehicle body shell component,
the antenna rod is arranged on an exterior side of the outer panel component and is coupled with the antenna base module, and
the separately mountable antenna base module is fastened to the vehicle body shell component.

2. The antenna assembly according to claim 1, wherein the antenna base module comprises an additional receiver element and an electronic system.

3. The antenna assembly according to claim 2, wherein the additional antenna receiver element is at least one of a DAB, GPS, GSN, SDARS, or TV antenna receiver element.

4. The antenna assembly according to claim 3, wherein the electronic system is at least one of a receiver, a transmitter, an amplifier, a filter, or a converter.

5. The antenna assembly according to claim 1, wherein the outer panel component of the vehicle body is made of a non-metallic material.

6. The antenna assembly according to claim 5, wherein the non-metallic material is a plastic.

7. An antenna assembly for a motor vehicle, comprising:
an antenna rod configured as an antenna receiver element;
a separately mountable antenna base module comprising a coupler and holder for the antenna rod,
an outer panel component of a vehicle body of the motor vehicle having an opening for detachably fastening the antenna rod; and
a vehicle body shell component of the motor vehicle, wherein
the antenna base module, including the coupler and holder for the antenna rod, is arranged under the outer panel component and between the outer panel component and the vehicle body shell component,
the antenna rod is arranged on an exterior side of the outer panel component and is coupled with the antenna base module, and
the outer panel component of the vehicle body is configured as a screen adjacent an upper end of a windshield or a rear window and the vehicle body shell component is configured as a structurally effective transverse roof bow of the motor vehicle.

8. The antenna assembly according to claim 7, wherein the motor vehicle is a convertible vehicle.

9. An antenna assembly for a motor vehicle, comprising:
an antenna rod configured as an antenna receiver element;
a separately mountable antenna base module comprising a coupler and holder for the antenna rod,
an outer panel component of a vehicle body of the motor vehicle having an opening for detachably fastening the antenna rod; and
a vehicle body shell component of the motor vehicle, wherein
the antenna base module, including the coupler and holder for the antenna rod, is arranged under the outer panel component and between the outer panel component and the vehicle body shell component,
the antenna rod is arranged on an exterior side of the outer panel component and is coupled with the antenna base module, and
the outer panel component of the vehicle body extends from a left roof side frame to a right roof side frame of the motor vehicle.

10. An antenna assembly for a motor vehicle, comprising:
an antenna rod configured as an antenna receiver element;
a separately mountable antenna base module comprising a coupler and holder for the antenna rod,
an outer panel component of a vehicle body of the motor vehicle having an opening for detachably fastening the antenna rod; and
a vehicle body shell component of the motor vehicle, wherein
the antenna base module, including the coupler and holder for the antenna rod, is arranged under the outer panel component and between the outer panel component and the vehicle body shell component,
the antenna rod is arranged on an exterior side of the outer panel component and is coupled with the antenna base module, and
in an area around the opening, the outer panel component is constructed with a projecting area elevated with respect to a remaining area of the outer panel component in order to form a space for the antenna base module underneath the projecting area.

11. The antenna assembly according to claim 10, wherein the elevated projecting area is configured with an aerodynamically fluid shape.

12. A motor vehicle, comprising:

a vehicle body having an outer panel component and a vehicle body shell component; and an antenna assembly comprising an antenna rod as an antenna receiver element and a separately mountable antenna base module comprising a coupler and holder for the antenna rod, wherein the antenna base module, including the coupler and holder for the antenna rod, is arranged under the outer panel component and between the outer panel component of the vehicle body and the vehicle body shell component, the antenna rod is arranged on an exterior side of the outer panel component of the vehicle body and is coupled to the antenna base module, and the separately mountable antenna base module is fastened to the vehicle body shell component.

13. The motor vehicle according to claim 12, wherein the antenna base module comprises an additional antenna receiver element and an electronic system.

14. The motor vehicle according to claim 12, wherein the outer panel component of the vehicle body is made of a non-metallic material.

15. A motor vehicle, comprising:

a vehicle body having an outer panel component and a vehicle body shell component; and an antenna assembly comprising an antenna rod as an antenna receiver element and a separately mountable antenna base module comprising a coupler and holder for the antenna rod, wherein the antenna base module, including the coupler and holder for the antenna rod, is arranged under the outer panel component and between the outer panel component of the vehicle body and the vehicle body shell component, the antenna rod is arranged on an exterior side of the outer panel component of the vehicle body and is coupled to the antenna base module, and the outer panel component of the vehicle body is configured as a screen adjacent an upper end of a windshield or a rear window and the vehicle body shell component is configured as a structurally effective transverse roof bow of the motor vehicle.

16. The motor vehicle according to claim 15, wherein the separately mountable antenna base module is fastened to at least one of the outer panel component of the vehicle body or the vehicle body shell component.

17. The motor vehicle according to claim 16, wherein the outer panel component of the vehicle body extends from a left roof side frame to a right roof side frame of the motor vehicle.

18. The antenna assembly according to claim 17, wherein:

in an area around the opening, the outer panel component is constructed with a projecting area elevated with respect to a remaining area of the outer panel component in order to form a space for the antenna base module underneath the projecting area.

* * * * *